US008413615B2

(12) United States Patent
Tsuge

(10) Patent No.: US 8,413,615 B2
(45) Date of Patent: Apr. 9, 2013

(54) HOT WATER SUPPLY APPARATUS

(75) Inventor: Chikara Tsuge, Nagoya (JP)

(73) Assignee: Rinnai Corporation, Aichi-ken (JP)

( * ) Notice: Subject to any disclaimer, the term of this patent is extended or adjusted under 35 U.S.C. 154(b) by 1147 days.

(21) Appl. No.: 12/337,037

(22) Filed: Dec. 17, 2008

(65) Prior Publication Data

US 2009/0159017 A1 Jun. 25, 2009

(30) Foreign Application Priority Data

Dec. 19, 2007 (JP) ..... 2007-327327

(51) Int. Cl.
*F24H 9/20* (2006.01)

(52) U.S. Cl.
USPC ..... 122/14.22; 374/57

(58) Field of Classification Search ..... 122/14.1–14.3; 73/204.11, 202.5, 204.17, 204.21, 204.23; 374/147, 148, 57, 4, 5
See application file for complete search history.

(56) References Cited

U.S. PATENT DOCUMENTS 4,151,862 A * 5/1979 Ueda et al. ..... 137/629
4,480,467 A * 11/1984 Harter et al. ..... 73/204.15
6,282,370 B1 * 8/2001 Cline et al. ..... 392/465
2007/0058313 A1 * 3/2007 Maddox ..... 361/93.1
2007/0058315 A1 * 3/2007 Maddox ..... 361/103
2007/0133656 A1 * 6/2007 Liu et al. ..... 374/147
2007/0257122 A1 * 11/2007 Shimada et al. ..... 237/12
2010/0282440 A1 * 11/2010 Trihey et al. ..... 165/104.19

FOREIGN PATENT DOCUMENTS

JP 2004-202122 7/2004

* cited by examiner

*Primary Examiner* — John K Fristoe, Jr.
*Assistant Examiner* — Matthew W Jellett
(74) *Attorney, Agent, or Firm* — Turocy & Watson, LLP

(57) ABSTRACT

A hot water supply apparatus including: a hot-water supply pipe for guiding hot water generated by a hot-water generator to a hot-water supplying terminal; two hot-water supply temperature sensors for detecting water temperature in the hot-water supply pipe; a temperature control unit for adjusting a temperature of the hot water supplied to the hot-water supplying terminal; a sensor abnormality determining unit for determining sensor abnormality when a difference between temperatures detected by the two hot-water supply temperature sensors is larger than a predetermined permissible error; a sensor selector for selectively setting one hot-water supply temperature sensor detecting a higher temperature as a hot-water supply temperature sensor for temperature control; and a hot-water supply temperature controller for controlling the temperature control unit so that a temperature detected by the hot-water supply temperature sensor for temperature control selected from the two hot-water supply temperature sensors is matched with a set temperature.

5 Claims, 5 Drawing Sheets

PRIOR ART

HOT WATER SUPPLY APPARATUS

BACKGROUND OF THE INVENTION

1. Field of the Invention

The present invention relates to a hot water supply apparatus having a hot water supply temperature sensor for temperature control and a hot water supply temperature sensor for comparison.

2. Description of the Related Art

In a hot water supply apparatus for controlling a temperature of hot water supplied to a hot-water supplying terminal based on a temperature detected by a hot-water supply temperature sensor, when a temperature detection accuracy is deteriorated due to abnormality in the hot-water supply temperature sensor, a deviation occurs between the temperature detected by the hot-water supply temperature sensor and a set temperature. As a result, there is a possibility that hot water having a higher temperature than the set temperature is supplied to the hot-water supplying terminal. From the above point of view, a hot water supply apparatus provided with another hot-water supply temperature sensor for determining whether the hot-water supply temperature sensor for temperature control is abnormal or not by comparison is known. (For example, Japanese Unexamined Patent Publication No. 2004-202122) According to the hot water supply apparatus, when a difference between the temperature detected by the hot-water supply temperature sensor for comparison and the temperature detected by the hot-water supply temperature sensor for temperature control is larger than a predetermined value, abnormality of the hot-water supply temperature sensor for temperature control is determined, and whereby supply of hot water can be stopped.

FIG. 5 is a schematic configuration diagram showing a conventional hot water supply apparatus provided with a hot-water supply temperature sensor for comparison. The hot water supply apparatus 9 has a cold-water pipe L1 for guiding cold water supplied from a water supply pipe to a mixed-water pipe L5 which will be described later, a hot-water pipe L2 for guiding hot water supplied from a hot-water generator such as a heat exchanger to the mixed-water pipe L5, and the mixed-water pipe L5 for guiding the cold water and the hot water to a hot-water supplying terminal P such as a shower or a faucet.

To a merging part of the cold-water pipe L1 and the hot-water pipe L2, a mixing valve 95 as a temperature control unit capable of adjusting supply proportions of the cold water and the hot water to the mixed-water pipe L5 is connected. By controlling the supply proportions by the mixing valve 95 based on a temperature detected by a hot-water supply temperature sensor 98*a* for temperature control which will be described later, the temperature of hot water supplied to the hot-water supplying terminal P is adjusted.

The mixed-water pipe L5 is provided with the hot-water supply temperature sensor 98*a* for temperature control for detecting the water temperature in the mixed-water pipe L5, a hot-water supply temperature sensor 98*b* for comparison, and a hot-water shutoff valve 99 capable of shutting off the supply of hot water to the hot-water supplying terminal P.

Further, a control circuit C9 for executing an operation of supplying hot-water to the hot-water supplying terminal P is assembled in the hot water supply apparatus 9. The mixing valve 95, the hot-water supply temperature sensor 98*a* for temperature control, the hot-water supply temperature sensor 98*b* for comparison, and the hot-water shutoff valve 99 are electrically connected to the control circuit C9.

The control circuit C9 includes, although not shown, a hot-water supply temperature control circuit for controlling operation of the mixing valve 95 based on the temperature detected by the hot-water supply temperature sensor 98*a* for temperature control, a sensor abnormality determining circuit for determining sensor abnormality when the difference between the temperature detected by the hot-water supply temperature sensor 98*a* for temperature control and the temperature detected by the hot-water supply temperature sensor 98*b* for comparison is larger than a predetermined value, and a hot-water supply inhibiting circuit for forcibly closing the hot-water shutoff valve 99 when the sensor abnormality is determined.

In the hot water supply apparatus, when a hot-water supply key in a remote controller R connected to the control circuit C9 via a communication cable is depressed, first, a sensor abnormality determining circuit determines whether the difference between the temperature detected by the hot-water supply temperature sensor 98*a* for temperature control and the temperature detected by the hot-water supply temperature sensor 98*b* for comparison is equal to or less than a predetermined value (for example, 1 K).

When the detection temperature difference is equal to or less than the predetermined value, the mixing valve 95 is controlled by a hot-water supply temperature control circuit, and the supply proportions of cold water and hot water to the merging part is adjusted so that the temperature detected by the hot-water supply temperature sensor 98*a* for temperature control is matched with the set temperature of the remote controller R.

On the other hand, in a case where the temperature detection accuracy of the hot-water supply temperature sensor 98*a* for temperature control is deteriorated, the detection temperature difference may exceed a predetermined value. In such a case, when adjustment for decreasing the supply proportion of the cold water to the merging part is performed based on the temperature detected by the hot-water supply temperature sensor 98*a* for temperature control, there is a possibility that hot water having a higher temperature than the set temperature can be supplied to the hot-water supplying terminal P. Consequently, abnormality of the hot-water supply temperature sensor is determined, and the hot-water shutoff valve 99 is closed by the hot-water supply inhibiting circuit.

As a result, supply of a high-temperature hot water to the hot-water supplying terminal P is stopped, so that it does not cause discomfort to a user.

In the conventional hot water supply apparatus, however, when it is determined that the hot-water supply temperature sensor for temperature control is abnormal, supply of hot water is stopped forcibly. Consequently, the hot water supply apparatus cannot be used until the hot-water supply temperature sensor for temperature control is replaced, thereby resulting in poor convenience.

SUMMARY OF THE INVENTION

The present invention has been achieved in view of the above circumstances and an object of the present invention is to provide a very convenient hot water supply apparatus.

According to one aspect of the present invention, there is provided hot water supply apparatus comprising:

a hot-water supply pipe for guiding hot water generated by a hot-water generator to a hot-water supplying terminal;

two hot-water supply temperature sensors for detecting water temperature in the hot-water supply pipe;

a temperature control unit for adjusting a temperature of the hot water supplied to the hot-water supplying terminal;

a sensor abnormality determining unit for determining sensor abnormality when a difference between temperatures detected by the two hot-water supply temperature sensors is larger than a predetermined permissible error;

a sensor selector for selectively setting one hot-water supply temperature sensor detecting a higher temperature as a hot-water supply temperature sensor for temperature control when the sensor abnormality is determined by the sensor abnormality determining unit; and a hot-water supply temperature controller for controlling the temperature control unit so that a temperature detected by the hot-water supply temperature sensor for temperature control selected from the two hot-water supply temperature sensors is matched with a set temperature.

Other objects, features and advantages of the present invention will become more fully understood from the detailed description given hereinbelow and the accompanying drawings which are given by way of illustration only, and thus are not to be considered as limiting the present invention.

DETAILED DESCRIPTION OF THE PREFERRED EMBODIMENTS

Figure 1:
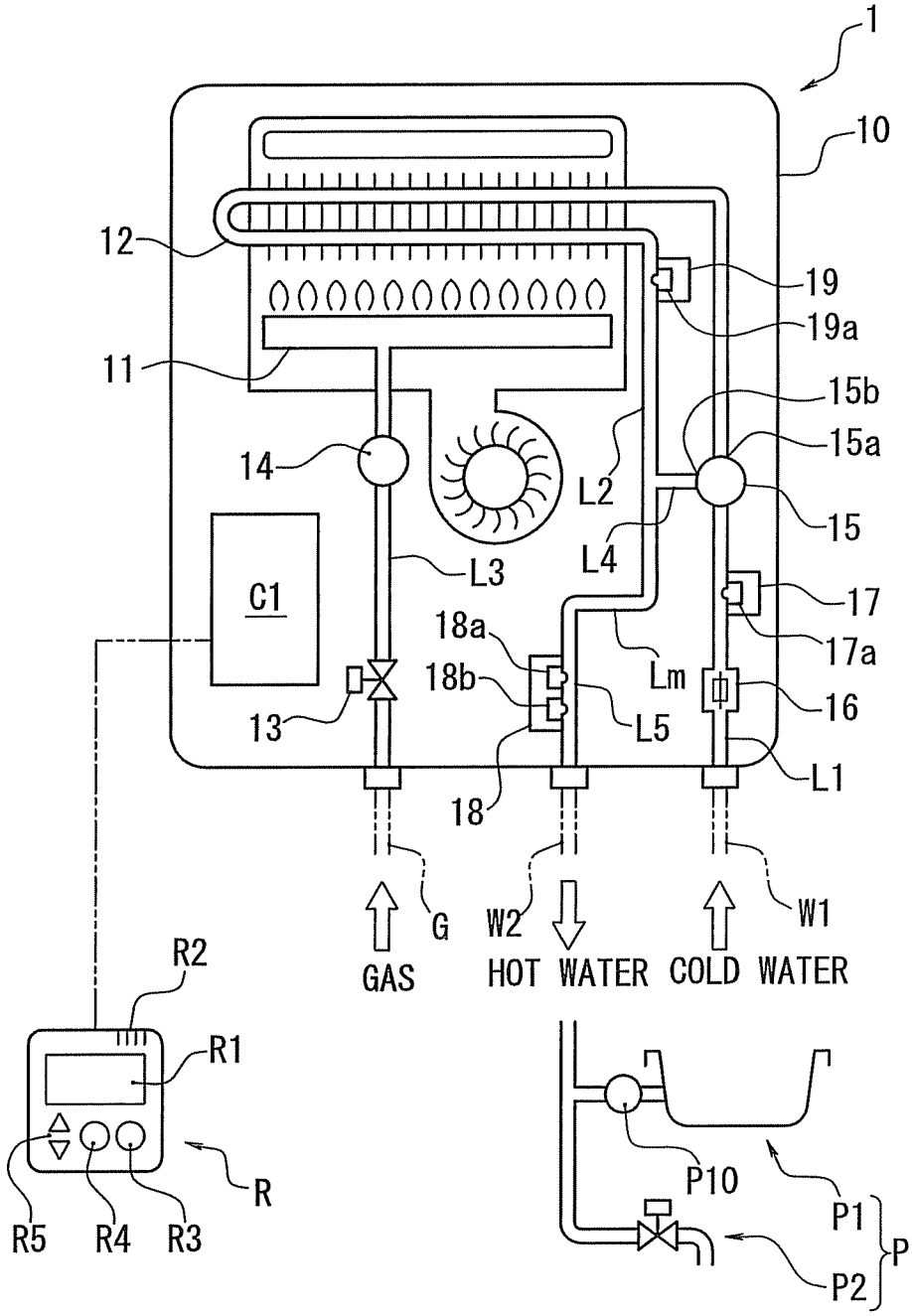
FIG. 1 is a schematic configuration diagram showing a hot water supply apparatus 1 according to an embodiment of the present invention.

Referring to the drawings, the best mode for carrying out the present invention is described below. FIG. 1 is a schematic configuration diagram showing a hot water supply apparatus according to an embodiment of the present invention. The respective elements of the hot water supply apparatus will be described in detail.

The hot water supply apparatus shown in FIG. 1 is a gas water heater 1 for heating cold water supplied from a water supply pipe W1 by combustion heat of gas, sending the hot water to a hot-water supply pipe W2, and supplying the hot water to a hot-water supplying terminal P such as a bathtub P1 and a faucet P2. The hot water supply apparatus has a gas burner 11 for burning gas fed from a gas pipe G and a heat exchanger 12 for collecting the combustion heat of the gas and generating hot water. The inlet side of the heat exchanger 12 is connected to the water supply pipe W1 via a cold-water pipe L1, and the outlet side of the heat exchanger 12 is connected to the hot-water supply pipe W2 via a hot-water pipe L2.

The heat exchanger 12 corresponds to a hot-water generator.

The gas burner 11 is connected to the gas pipe G via a gas supply pipe L3. The gas supply pipe L3 is provided with a gas shutoff valve 13 capable of shutting off supply of gas to the gas burner 11 and a gas amount adjusting valve 14 capable of adjusting the supply amount of gas to the gas burner 11. By controlling the opening of the gas amount adjusting valve 14 based on a detection temperature detected by a thermistor for temperature control which will be described later, the temperature of hot water supplied to the hot-water supply pipe W2 is controlled.

The gas amount adjusting valve 14 corresponds to a temperature control unit.

On the other hand, the cold-water pipe L1 is provided with, in order from the upstream side, a flow sensor 16 for detecting a flow amount of cold water sent from the water supply pipe W1, a water temperature sensor 17 having a thermistor (hereinafter, referred to as "inlet-side thermistor") 17*a* for detecting a temperature of the cold water, and a flow diverter valve 15 capable of diverting the cold water to the hot-water pipe L2 side.

The inlet-side thermistor 17*a* corresponds to an inlet water temperature sensor.

The hot-water pipe L2 is provided with a hot-water temperature sensor 19 having a thermistor (hereinafter, referred to as "outlet-side thermistor") 19*a* for detecting a temperature of the hot water sent from the outlet side of the heat exchanger 12.

To the flow diverter valve 15, a bypass pipe L4 connected to the hot-water pipe L2 is connected. By controlling an opening ratio between a water exit port 15*a* on the heat exchanger 12 side (hereinafter, referred to as "heat-source-side water exit port") of the flow diverter valve 15 and a water exit port 15*b* on the bypass pipe L4 side (hereinafter, referred to as "bypass-side water exit port") of the flow diverter valve 15 based on the temperature detected by the outlet-side thermistor 19*a*, the temperature of the hot water sent to a merging part between the hot-water pipe L2 and the bypass pipe L4 is controlled.

Further, in a pipe L5 on a downstream side of the merging part in the hot-water pipe L2 (hereinafter, referred to as "mixed-water pipe"), an almost S-shaped curved part Lm in which cold water and hot water supplied to the merging part are mixed uniformly is formed. On the further downstream side of the curved part Lm, a water temperature sensor (hereinafter, referred to as "mixed water temperature sensor") 18 for detecting the temperature of mixed water of the cold water and the hot water by two thermistors 18*a* and 18*b* is disposed.

Figure 2:
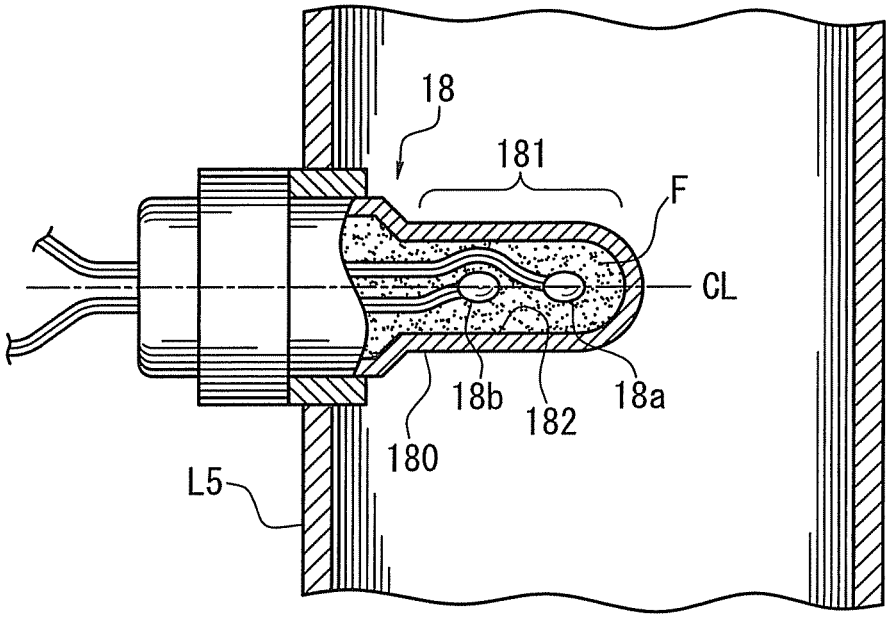
FIG. 2 is a partial cross sectional view showing a mixed water temperature sensor 18 in the hot water supply apparatus 1 according to the embodiment of the present invention.

As shown in FIG. 2, in a front end portion 181 of a cylindrical sensor case 180 made of a metal material having high thermal conductivity (for example, stainless steel), the first and second thermistors 18*a* and 18*b* changing electric resistance in accordance with conductive heat from the sensor case 180 are housed. The mixed water temperature sensor 18 is inserted almost horizontally toward the center of the mixed water pipe L5.

The sensor case 180 is filled with a filling material (for example, epoxy resin) F having high thermal conductivity. The first and second thermistors 18*a* and 18*b* are fixed on a center line CL of the front end portion 181 so as not to be in contact with an inner peripheral surface 182. Therefore, a gap between each of the first and second thermistors 18*a* and 18*b* and the inner peripheral surface 182 of the front end portion 181 is held so that a distance between the first thermistor 18*a* and the inner peripheral surface 182 and a distance between the second thermistor 18*b* and the inner peripheral surface 182 are almost the same. With this configuration, the water temperature in the mixed water pipe L5 is transmitted uniformly to the first and second thermistors 18*a* and 18*b* from the surface of the sensor case 180 via the filling material F.

Specifically, since the first and second thermistors 18*a* and 18*b* are disposed in almost the same environment, variations in the detection temperatures due to the difference in the thermistor mounting environments can be suppressed. Therefore, a sensor abnormality determination accuracy is improved.

Further, according to the above configuration, since the first and second thermistors 18*a* and 18*b* are assembled in one sensor case 180, both thermistors 18*a* and 18*b* can be simultaneously detached from the gas water heater 1. Consequently, not only is an assembly workability of the gas water heater 1 improved, but also defective assembling of the first and second thermistors 18*a* and 18*b* can be reduced.

As the first and second thermistors 18*a* and 18*b*, a thermistor having a characteristic that an electric resistance value of an inner resistor changes exponentially with respect to a detection temperature, that is, a thermistor of a negative characteristic is employed. Therefore, for example, when the resistor is disconnected, the electric resistance value reaches an infinite value, and a detection temperature similar to that in a case where extremely low temperature is detected is shown.

The first and second thermistors 18*a* and 18*b* correspond to two hot-water supply temperature sensors and the mixed water pipe L5 corresponds to a hot-water supply pipe.

As shown in FIG. 1, a control circuit C1 for controlling hot-water supplying operation of the gas water heater 1 is assembled in a water heater body 10.

The control circuit C1 is electrically connected to the gas shutoff valve 13, the gas amount adjusting valve 14, the flow diverter valve 15, the inlet-side thermistor 17*a*, the first thermistor 18*a*, the second thermistor 18*b*, and the outlet-side thermistor 19*a*. Also, the control circuit C1 is connected to an external remote controller R via a communication cable.

The control circuit C1 includes, although not shown, an ignition/extinction circuit for controlling igniting/extinguishing operation of the gas burner 11 in accordance with the flow amount detected by the flow sensor 16, a hot-water supply temperature control circuit for controlling operations of the gas amount adjusting valve 14 and the flow diverter valve 15 so that a detection temperature T2 detected by a thermistor for temperature control is matched with a hot-water supply temperature (hereinafter, referred to as "set temperature") Ts set by a remote controller R, a sensor abnormality determining circuit for determining sensor abnormality when a difference between a detection temperature Ta detected by the first thermistor 18*a* and a detection temperature Tb detected by the second thermistor 18*b* is larger than a predetermined permissible error S1, a sensor selection circuit for, when the sensor abnormality is determined, selectively setting either one of the first thermistor 18*a* and the second thermistor 18*b*, which detects a higher temperature, as the thermistor for temperature control, a high temperature determining circuit for determining a hot-water supply temperature abnormality when a difference between the detection temperature T2 detected by the thermistor for temperature control and the detection temperature T1 detected by the inlet-side thermistor 17*a* is equal to or larger than a predetermined reference temperature difference S2, a hot-water supply inhibiting circuit for inhibiting supply of hot water to the hot-water supply pipe W2 when the hot-water supply temperature abnormality is determined by the high temperature determining circuit, a notifying circuit for, when the sensor abnormality is determined by the sensor abnormality determining circuit, notifying an abnormal state of the mixed water temperature sensor 18 from a display unit R1 and a sound output unit R2 of the remote controller R, and a microcomputer storing a program for making these circuits operated interlockingly.

The hot-water supply temperature control circuit corresponds to a hot-water supply temperature controller and the sensor abnormality determining circuit corresponds to a sensor abnormality determining unit. The sensor selection circuit corresponds to a sensor selector and the thermistor for temperature control set by the sensor selection circuit corresponds to a hot-water supply temperature sensor for temperature control.

The high temperature determining circuit corresponds to a high temperature determining unit and the notifying circuit corresponds to a notifying unit.

(Sensor Abnormality Determining Operation)

Figure 3:
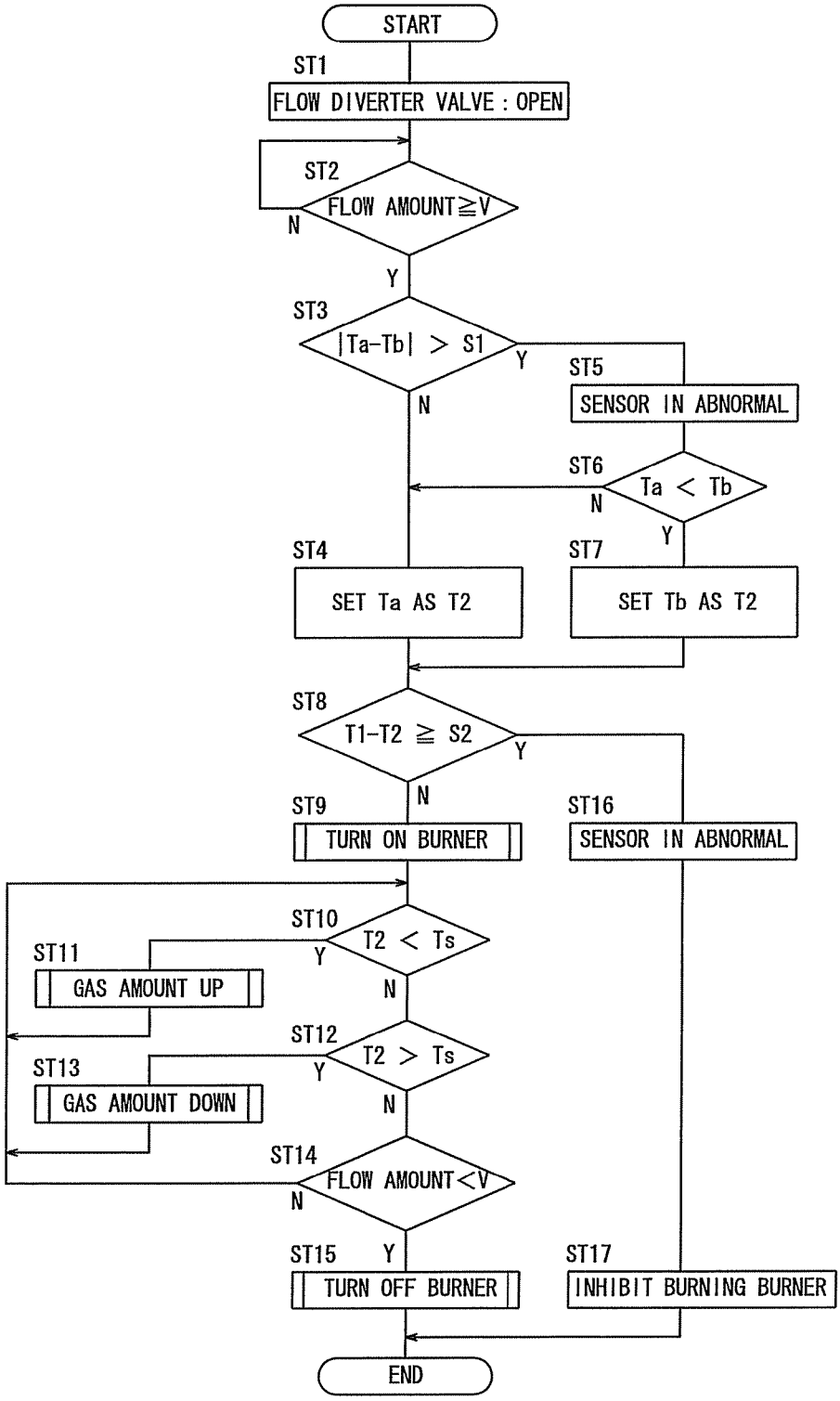
FIG. 3 is an operation flowchart showing sensor abnormality determining operation of the hot water supply apparatus 1 according to the embodiment of the present invention.

The sensor abnormality determining operation by the control circuit C1 will now be described with reference to an operation flowchart of FIG. 3.

First, when an operation button R3 of the remote controller R is depressed, the hot-water supply temperature control circuit adjusts the opening of the flow diverter valve 15 so that the opening ratio between the heat-source-side water exit port 15*a* and the bypass-side water exit port 15*b* becomes a predetermined ratio (for example, the opening of the heat-source-side water exit port 15*a* is 80% and the opening of the bypass-side water exit port 15*b* is 20%), and the ignition/extinction circuit monitors whether the flow amount detected by the flow sensor 16 is equal to or larger than a predetermined value V (ST1 and ST2).

When a hot-water filling button R4 of the remote controller R is depressed to open an open/close valve P10 of the bathtub P1 or the faucet P2 is opened, thereby starting supply of a cold water having a predetermined amount V or larger (the flow amount detected by the flow sensor 16 reaches a predetermined value V) from the water supply pipe W1 to the heat exchanger 12 via the cold-water pipe L1, the sensor abnormality determining circuit determines whether the difference between the detection temperature Ta calculated from the electric resistance value of the first thermistor 18*a* and the detection temperature Tb calculated from the electric resistance value of the second thermistor 18*b* (hereinafter, referred to as "the detection temperature difference") is larger than the predetermined permissible error S1 (for example, 2° C.) (ST3).

As a result, in step ST3, when the detection temperature difference (|Ta−Tb|) is equal to or less than the permissible error S1, it is regarded that the first and second thermistors 18*a* and 18*b* are normal, and the detection temperature Ta of the first thermistor 18*a* preliminarily selected is set as the detection temperature T2 of the thermistor for temperature control (ST4).

On the other hand, when the detection hot-water temperature difference (|Ta−Tb|) is larger than the permissible error S1, there is a possibility that the temperature detection accuracy of one of the two thermistors is deteriorated as when the resistor in the first thermistor 18*a* is disconnected and extremely low detection temperature is shown. Therefore, it is notified that the mixed water temperature sensor 18 is in an abnormal state by sound or display from the display unit R1 and the sound output unit R2 of the remote controller R, and the operation of selecting the thermistor for temperature control is executed by the sensor selection circuit.

Concretely, the detection temperature Ta of the first thermistor 18*a* and the detection temperature Tb of the second thermistor 18*b* are compared with each other. When the detection temperature Ta of the first thermistor 18*a* is equal to or higher than the detection temperature Tb of the second thermistor 18*b*, the detection temperature Ta of the first thermistor 18*a* is set as the detection temperature T2 of the thermistor for temperature control (ST4). On the other hand, when the detection temperature Ta of the first thermistor 18*a* is lower than the detection temperature Tb of the second thermistor 18*b*, the detection temperature Tb of the second thermistor 18*b* is set as the detection temperature T2 of the thermistor for temperature control (ST5 to ST7).

With this configuration, by hot-water supplying operation of step ST9 and subsequent steps which will be described later, one thermistor reducing a temperature of hot water supplied to the hot-water supply pipe W2 is set as the thermistor for temperature control.

After the one thermistor for temperature control is set by the operations in steps ST3 to ST7, whether a value obtained by subtracting the detection temperature T2 of the thermistor for temperature control from the detection temperature T1 of the inlet-side thermistor 17*a* (hereinafter, referred to as "detection temperature difference between the outlet side and the inlet side") is equal to or larger than a predetermined reference temperature difference S2 (for example, 3° C.) is determined by a high-temperature determining circuit (ST8).

As a result, when the detection temperature difference between the outlet side and the inlet side (T1−T2) is smaller than the predetermined reference temperature difference S2, operation of supplying hot water to the hot-water supply pipe W2 is executed.

Concretely, first, the gas shutoff valve 13 and the gas amount adjusting valve 14 are opened by the ignition/extinction circuit, the supply of gas from the gas pipe G to the gas burner 11 via the gas supply pipe L3 is started, and a combustion fan is rotated. Also, Spark discharge is performed by an ignition electrode (not shown) to turn on the gas burner 11, and the gas is burnt by the gas burner 11 (ST9).

With this operation, the cold water supplied from the water supply pipe W1 to the cold-water pipe L1 absorbs combustion heat of the gas burner 11 when it passes through the heat exchanger 12, and is sent as hot water to the mixed water pipe L5 via the hot-water pipe L2. A part of the cold water supplied to the cold-water pipe L1 is sent from the bypass-side water exit port 15*b* of the flow diverter valve 15 to the mixed-water pipe L5 via the bypass pipe L4.

When the detection temperature T2 of the thermistor for temperature control (for example, the detection temperature Ta of the first thermistor 18*a*) is lower than the set temperature Ts, the opening of the gas amount adjusting valve 14 is adjusted to increase the supply amount of gas to the gas burner 11. On the other hand, when the detection temperature T2 of the thermistor for temperature control is higher than the set temperature Ts, the opening of the gas amount adjusting valve 14 is adjusted to decrease the supply amount of gas to the gas burner 11. As a result, the hot water of the set temperature Ts is supplied from the mixed water pipe L5 to the hot-water supply pipe W2 (ST10 to ST13).

After that, when the hot-water filling button R4 of the remote controller R is depressed again to close the open/close valve P10 of the bathtub P1 or the faucet P2 is closed, and whereby the predetermined amount V or more of the cold water is not supplied from the water supply pipe W1 via the cold-water pipe L1 to the heat exchanger 12 (namely, the flow amount detected by the flow sensor 16 becomes less than the predetermined value V), the ignition/extinction circuit closes the gas amount adjusting valve 14 and the gas shutoff valve 13 to turn off the gas burner 11 (ST14 and ST15).

On the other hand, in step ST8, when the detection temperature difference between the outlet side and the inlet side (T1−T2) is equal to or larger than the predetermined reference temperature difference S2, it may be in an abnormal state of hot-water supply temperature detection that the detection temperature T2 of the thermistor for temperature control set by the operations in steps ST3 to ST7 is lower than the actual water temperature in the mixed-water pipe L5. Therefore, it is notified that the mixed water temperature sensor 18 is in an abnormal state by sound or display from the display unit R1 and the sound output unit R2 of the remote controller R. Further, the gas amount adjusting valve 14 is forcibly closed, and the burning operation of the gas burner 11 is inhibited. As a result, the supply of hot water to the hot-water supply pipe W2 is inhibited (ST16 and ST17).

According to the above hot water supply apparatus, even in a case where the detection temperature of the first thermistor 18*a* is extremely low due to, for example, disconnection of the resistor in the first thermistor 18*a* or deterioration due to aging, the temperature control operation is performed based on the detection temperature Tb of the second thermistor 18*b* which supplies a lower-temperature hot water to the hot-water supply pipe W2 upon execution of the hot-water supplying operation. Therefore, until the first thermistor 18*a* in the abnormal condition is replaced, hot water can be supplied temporarily to a hot-water supplying terminal P. Thus, it can be obtained high convenience.

By performing the hot-water supplying operation based on the detection temperature Tb of the second thermistor 18*b* supplying the lower-temperature hot water to the hot-water supply pipe W2, supply of a high-temperature hot water at the time of temporarily use is prevented. Accordingly, it does not cause discomfort to a user by supply of the high-temperature hot water.

Further, for example, when both of the first and second thermistors 18*a* and 18*b* are in abnormal conditions and the detection temperatures of the thermistors are lower than the actual water temperature in the mixed water pipe L5, the heat-source-side water exit port 15*a* of the flow diverter valve 15 is closed and supply of hot water to the hot-water supply pipe W2 is inhibited. Therefore, supply of high-temperature hot water to the hot-water supplying terminal P can be prevented. Thus, improved safety is obtained.

Furthermore, in a case where at least one of the first thermistor 18*a* and the second thermistor 18*b* is in the abnormal condition, the state where the mixed water temperature sensor 18 is abnormal can be promptly notified to the user by sound or display. There is consequently no inconvenience that the user continuously uses the gas water heater 1 without knowing the abnormality.

Other Embodiments

In the foregoing embodiment, the sensor abnormality determining operation in step ST3 is executed at a point when the flow amount detected by the flow sensor 16 reaches a predetermined value. Alternatively, the sensor abnormality determining operation may be executed when the operation button R3 of the remote controller R is depressed, or after the gas burner 11 is turned on.

In the foregoing embodiment, in a case where it is determined in step ST3 that the first and second thermistors 18*a* and 18*b* are normal, the detection temperature Ta detected by the first thermistor 18*a* which is preliminarily selected is set as the detection temperature T2 of the thermistor for temperature control. Alternatively, the detection temperature Tb detected by the second thermistor 18*b* may be preliminarily set as the detection temperature T2 of the thermistor for temperature control. It is also possible to calculate an average value A between the detection temperature Ta detected by the first thermistor 18*a* and the detection temperature Tb detected by the second thermistor 18*b* and set the average value A as the detection temperature T2 of the thermistor for temperature control.

In the foregoing embodiment, the operations in steps ST3 to ST7 are performed before the execution of the hot-water supplying operation of steps ST9 to ST15. Alternatively, the operations may be performed before and during execution of the hot-water supplying operation.

Further, in the foregoing embodiment, when the abnormality state of the hot-water supply temperature detection, in which the detection temperature T2 of the thermistor for temperature control is lower than the actual water temperature, is determined, the gas amount adjustment valve 14 is forcibly closed, the burning operation of the gas burner 11 is inhibited, and supply of hot water to the hot-water supply pipe W2 is inhibited. Alternatively, by forcibly closing the gas shutoff valve 13, the burning operation of the gas burner 11 may be inhibited. Furthermore, by providing the hot-water pipe L2 or the mixed water pipe L5 with a hot water shutoff valve and forcibly closing the hot water shutoff valve, supply of hot water to the hot-water supply pipe W2 may be inhibited.

In the foregoing embodiment, the state where the mixed water temperature sensor 18 is abnormal is notified by the display unit R1 and the sound output unit R2 of the remote controller R. Alternatively, it is also possible to assemble a display unit and a sound output unit in the water heater body 10 and notify of the abnormal state from the display unit and the sound output unit.

Figure 4:
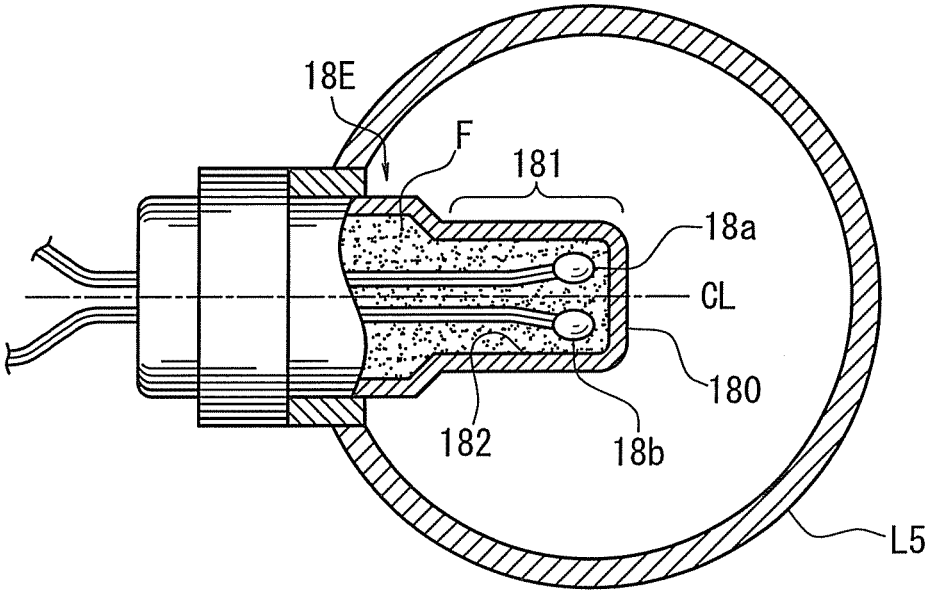
FIG. 4 is a partial cross sectional view showing a mixed water temperature sensor 18E in the hot water supply apparatus 1 according to another embodiment of the present invention.
Figure 5:
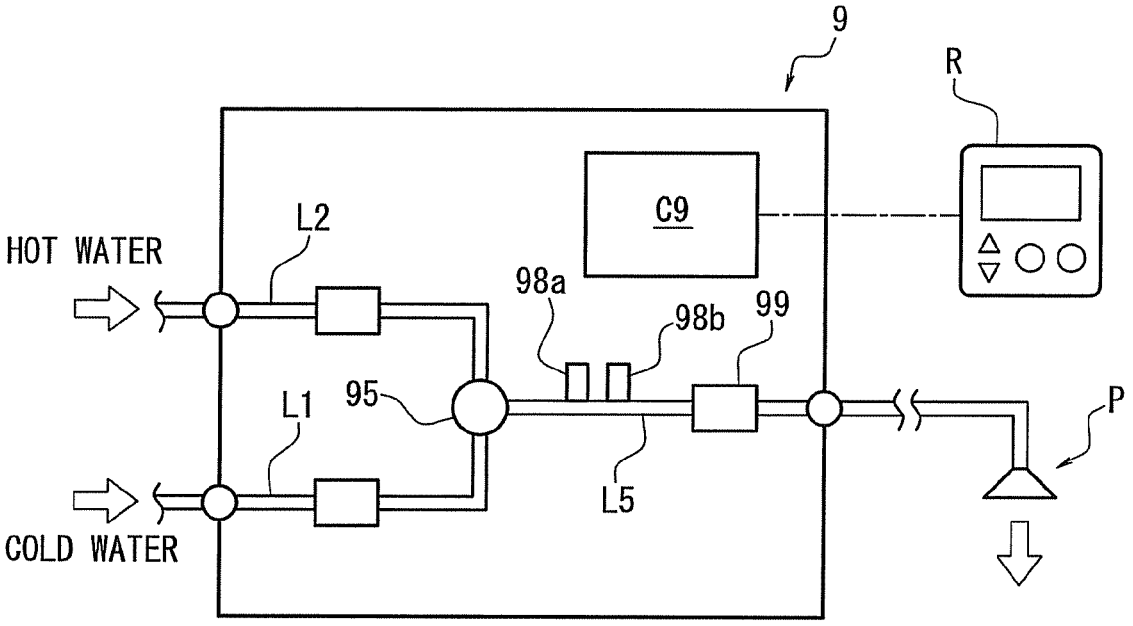
FIG. 5 is a schematic configuration diagram showing a conventional hot water supply apparatus 9.

In the foregoing embodiment, the mixed water temperature sensor 18 has a configuration that the first and second thermistors 18*a* and 18*b* are arranged in approximately parallel on the center line CL of the front end portion 181 in the sensor case 180. As shown in FIG. 4, it is also possible to insert the sensor case 180 in the mixed water pipe L5 so that the center of the mixed water pipe L5 is positioned on the center line CL of the front end portion 181 and arrange the first and second thermistors 18*a* and 18*b* symmetrically with respect to the center line CL in the front end portion 181.

With this configuration, a gap between each of the first and second thermistors 18*a* and 18*b* and the inner peripheral surface 182 of the front end portion 181 is held in such a manner that the distance between the first thermistor 18*a* and the inner peripheral surface 182 and the distance between the second thermistor 18*b* and the inner peripheral surface 182 are almost the same. In addition, the first and second thermistors 18*a* and 18*b* are arranged in parallel in positions at almost equal distances from the outer peripheral surface of the mixed water pipe L5. Consequently, variations in the detection temperatures according to the differences in installation environments can be suppressed.

Further, in the foregoing embodiment, the cold water and the hot water supplied to the merging part are mixed uniformly by the curved part Lm formed in the mixed water pipe L5. Alternatively, it is also possible to provide an agitating member for generating turbulent flow or vortex flow on the upstream side of the mixed water temperature sensor 18 and mix the cold water and the hot water uniformly by the agitating member.

As described above in detail, according to one aspect of the present invention, there is provided a hot water supply apparatus comprising:

a hot-water supply pipe for guiding hot water generated by a hot-water generator to a hot-water supplying terminal;

two hot-water supply temperature sensors for detecting water temperature in the hot-water supply pipe;

a temperature control unit for adjusting a temperature of the hot water supplied to the hot-water supplying terminal;

a sensor abnormality determining unit for determining sensor abnormality when a difference between temperatures detected by the two hot-water supply temperature sensors is larger than a predetermined permissible error;

a sensor selector for selectively setting one hot-water supply temperature sensor detecting a higher temperature as a hot-water supply temperature sensor for temperature control when the sensor abnormality is determined by the sensor abnormality determining unit; and a hot-water supply temperature controller for controlling the temperature control unit so that a temperature detected by the hot-water supply temperature sensor for temperature control selected from the two hot-water supply temperature sensors is matched with a set temperature.

According to the above hot water supply apparatus, in a case where the temperature detection accuracy of either one of the two hot-water supply temperature sensor drops due to, for example, disconnection of the resistor or deterioration due to aging, and whereby the detection temperature difference detected between the two hot-water supply temperature sensors is larger than the predetermined value before heating operation, one hot-water supply temperature sensor detecting higher temperature that more reduces a temperature of hot water supplied to the hot-water supplying terminal is set as the hot-water supply temperature sensor for temperature control. With this configuration, since a hot-water supply temperature control operation is performed in such a manner that the higher temperature detected by the one hot-water supply temperature sensor for temperature control set by the sensor selector is matched with the set temperature, the hot water having lower temperature is supplied to the hot-water supplying terminal. Therefore, until the hot-water supply temperature sensor in the abnormal condition is replaced, the hot water can be supplied temporarily preventing from supply of a high-temperature hot water.

According to the above hot water supply apparatus, following effects can be obtained. That is, even if either one of the two hot-water supply temperature sensor is in abnormal condition, the one hot-water supply temperature sensor which supplies a lower-temperature hot water to the hot-water supplying terminal is set as the hot-water supply temperature sensor for temperature control. Thus, by performing the hot-water supply temperature control operation based on the temperature detected by the one hot-water supply temperature sensor, hot water can be supplied temporarily until the hot-water supply temperature sensor in the abnormal condition is replaced. Accordingly, improved convenience can be obtained.

Further, since the hot-water supply temperature control operation is performed based on the temperature detected by the one hot-water supply temperature sensor which supplies the lower-temperature hot water to the hot-water supplying terminal, hot water can be supplied temporarily preventing from supply of a high-temperature hot water. Accordingly, it does not cause discomfort to a user by supply of the high-temperature hot water.

In the hot water supply apparatus above, the two hot-water supply temperature sensors may be housed in a cylindrical sensor case whose front end portion is inserted toward a center of the hot-water supply pipe, and the two hot-water supply temperature sensors may be arranged in approximately parallel in the front end portion of the cylindrical sensor case.

According to the above hot water supply apparatus, since the two hot-water supply temperature sensors may be housed in a cylindrical sensor case whose front end portion is inserted toward a center of the hot-water supply pipe, a water temperature in the hot-water supply pipe is transmitted uniformly to the two hot-water supply temperature sensors via the sensor case. Accordingly, variations in the detection temperatures can be suppressed.

According to the above hot water supply apparatus, following effects can be obtained. That is, since the two hot-water supply temperature sensors are disposed in one single sensor case, variations in the detection temperatures due to the difference in the mounting environments can be suppressed. Therefore, sensor abnormality determination accuracy can be improved.

The above hot water supply apparatus preferably includes a cold-water pipe for guiding cold water supplied from a water supply pipe to the hot-water generator;

an inlet water temperature sensor for detecting water temperature in the cold-water pipe; and a hot-water supply inhibiting unit for inhibiting supply of hot water to the hot-water supply pipe when the temperature detected by the hot-water supply temperature sensor for temperature control is lower than the water temperature detected by the inlet water temperature sensor.

According to the above hot water supply apparatus, in a case where the detection temperature detected by the hot-water supply temperature sensor for temperature control is lower than the water temperature detected by the inlet water temperature sensor for detecting water temperature in the cold-water pipe before heating, it may be in an abnormal state of hot-water supply temperature detection where the detection temperature of the hot-water supply temperature sensor for temperature control is lower than the actual water temperature. Accordingly, in such a case, supply of hot water to the hot-water supplying terminal is inhibited.

Namely, when both of the two hot-water supply temperature sensors are in abnormal conditions and those detection temperatures are lower than the actual water temperature before heating, there is a possibility that hot water having a higher temperature than the set temperature is supplied to the hot-water supplying terminal. Accordingly, by inhibiting supply of the hot water to the hot-water supplying terminal, supply of a high-temperature hot water to the hot-water supplying terminal can be avoided.

According to the above hot water supply apparatus, following effects can be obtained. Namely, when both of the two hot-water supply temperature sensors are in abnormal conditions, supply of hot water to the hot-water supply pipe is inhibited, and whereby supply of the high-temperature hot water to the hot-water supplying terminal can be avoided. Accordingly, improved safety is obtained.

The above hot water supply apparatus preferably includes a notifying unit for notifying information that at least one of the two hot-water supply temperature sensors is in an abnormal state from an information output unit by display or sound, when the sensor abnormality is determined by the sensor abnormality determining unit.

According to the above hot water supply apparatus, in a case where the temperature detection accuracy of at least one of the two hot-water supply temperature sensors is deteriorated, and whereby a difference between temperatures detected by the two hot-water supply temperature sensors is larger than the predetermined permissible error, the state where at lease one of the two hot-water supply temperature sensors is abnormal can be promptly notified to the user by sound or display. Accordingly, even when hot water is supplied temporarily, it is made a possible of promptly notifying the sensor abnormality to the user, and whereby the user can be prompted repair or exchange of the hot-water supply temperature sensors.

According to the above hot water supply apparatus, following effects can be obtained. Namely, even when hot water is supplied temporarily, the user can promptly recognize the sensor abnormality, and whereby the user can be prompted repair or exchange of the hot-water supply temperature sensors. There is consequently no inconvenience that the user continuously uses the gas water heater without knowing the abnormality.

The present application claims a priority based on a Japanese Patent Application No. 2007-327327 filed on Dec. 19, 2007, the content of which is hereby incorporated by reference in its entirely.

Although the present invention has been described in detail, the foregoing descriptions are merely exemplary at all aspects, and do not limit the present invention thereto. It should be understood that an enormous number of unillustrated modifications may be assumed without departing from the scope of the present invention.

What is claimed is:

1. A hot water supply apparatus comprising:

a hot-water supply pipe for guiding hot water generated by a hot-water generator to a hot-water supplying terminal;

two hot-water supply temperature sensors for detecting water temperature in the hot-water supply pipe;

a temperature control unit for adjusting a temperature of hot water supplied to the hot-water supplying terminal;

a sensor abnormality determining unit for determining sensor abnormality of temperature detection accuracy when a different between temperatures detected by the two hot-water supply temperature sensors is larger than a predetermined permissible error;

a sensor selector for selectively setting one hot-water supply temperature sensor detecting a higher temperature as a hot-water supply temperature sensor for temperature control when the sensor abnormality is determined by the sensor abnormality determining unit; and a hot-water supply temperature controller for controlling the temperature control unit so that a temperature detected by the hot-water supply temperature sensor for temperature control selected form the two hot-water temperature sensors is matched with a set temperature.

2. The hot water supply apparatus according to claim 1, wherein the two hot-water supply temperature sensors are housed in a cylindrical sensor case whose front end portion is inserted toward a center of a the hot-water supply pipe, and the two hot-water supply temperature sensors are arranged in approximately parallel in the front end portion of the cylindrical sensor case.

3. The hot water supply apparatus according to claim 1 further comprising:

a cold-water pipe for guiding cold water supplied form a water supply pipe to the hot-water generator;

an inlet water temperature sensor for detecting water temperature in the cold-water pipe; and a hot-water supply inhibiting unit for inhibiting supply of hot water to the hot-water supply pipe when the temperature detected by the hot-water supply temperature sensor for temperature control is lower than the water temperature detected by the inlet water temperature sensor.

4. The hot water supply apparatus according to claim 1 further comprising:

a notifying unit for notifying information that at least one of the two hot-water supply temperature sensors is in an abnormal state from an information output unit by display or sound, when the sensor abnormality is determined by the sensor abnormality determining unit.

5. The hot water supply apparatus according to claim 1, further comprising:

a cold-water pipe for guiding cold water supplied from a water supply pipe to the hot-water generator; and a bypass pipe connecting the hot-water supply pipe and the cold water pipe, wherein the two hot-water supply temperature sensors are provided downstream of a merging part of the hot-water supply pipe and the bypass pipe.

* * * * *